US007981222B2

(12) United States Patent
Colon

(10) Patent No.: US 7,981,222 B2
(45) Date of Patent: Jul. 19, 2011

(54) DISHWASHER HAVING SOUND ATTENUATING STRUCTURES

(75) Inventor: Mario Ascander Colon, Raleigh, NC (US)

(73) Assignee: Electrolux Home Prducts, Inc., Cleveland, OH (US)

( * ) Notice: Subject to any disclaimer, the term of this patent is extended or adjusted under 35 U.S.C. 154(b) by 230 days.

(21) Appl. No.: 12/360,700

(22) Filed: Jan. 27, 2009

(65) Prior Publication Data

US 2010/0187958 A1 Jul. 29, 2010

(51) Int. Cl.
*B08B 3/02* (2006.01)

(52) U.S. Cl. ..... 134/25.2; 134/200; 134/201

(58) Field of Classification Search ..... 68/3 R, 68/196; 134/25.2, 200, 201
See application file for complete search history.

(56) References Cited

U.S. PATENT DOCUMENTS

| | | | | |
|---|---|---|---|---|
| 3,295,541 | A | 1/1967 | Ummel | |
| 3,386,527 | A * | 6/1968 | Daubert et al. | 181/208 |
| 3,767,499 | A * | 10/1973 | Koss | 156/181 |
| 5,044,705 | A | 9/1991 | Nelson | |
| 5,158,346 | A * | 10/1992 | Marks et al. | 312/204 |
| 5,164,260 | A * | 11/1992 | Yoshinaka et al. | 428/328 |
| 5,855,353 | A * | 1/1999 | Shaffer et al. | 248/638 |
| 5,965,851 | A * | 10/1999 | Herreman et al. | 181/200 |
| 6,152,259 | A | 11/2000 | Freist et al. | |
| 6,260,660 | B1 | 7/2001 | Yoerkie, Jr. et al. | |
| 6,296,076 | B1 * | 10/2001 | Hiers et al. | 181/290 |
| 6,337,143 | B1 | 1/2002 | Ragland et al. | |
| 6,539,955 | B1 | 4/2003 | Tilton et al. | |
| 6,790,520 | B1 | 9/2004 | Todd et al. | |
| RE39,260 | E | 9/2006 | Byrd et al. | |
| 7,331,539 | B2 | 2/2008 | Jara-Almonte et al. | |
| 7,334,589 | B2 | 2/2008 | Jordan et al. | |
| 7,409,959 | B2 * | 8/2008 | Retsema | 134/56 D |
| 2002/0134615 | A1 | 9/2002 | Herreman et al. | |
| 2006/0266385 | A1 | 11/2006 | Malaker | |
| 2007/0102029 | A1 | 5/2007 | Panther | |
| 2007/0175907 | A1 | 8/2007 | Kempe et al. | |
| 2007/0252303 | A1 | 11/2007 | Loen et al. | |
| 2007/0272285 | A1 | 11/2007 | Herreman et al. | |

(Continued)

FOREIGN PATENT DOCUMENTS

| | | |
|---|---|---|
| DE | 37 09 080 | 12/1988 |

(Continued)

OTHER PUBLICATIONS

International Search Report for Application No. PCT/US2010/021710 mailed Jun. 1, 2010.

*Primary Examiner* — Frankie L Stinson
(74) *Attorney, Agent, or Firm* — Alston & Bird LLP

(57) ABSTRACT

Embodiments of dishwashers with sound attenuating properties are provided. The dishwashers include one or more laminated structures for attenuating sound. The structure may include a layer of an acoustic tape having a plurality of bi-direction fibers configured to redirect and convert sound generated by the dishwasher into heat such that the sound perceivable outside the dishwasher is reduced. The structure may further include one or more layers of foam for absorbing sound and one or more layers of vinyl for converting sound into heat. Panels of the laminated structure may be positioned in, around, and along the toe plate assembly, the door assembly, the base and tub of the dishwasher, and framing elements of the dishwasher.

17 Claims, 10 Drawing Sheets

U.S. PATENT DOCUMENTS

| | | | |
|---|---|---|---|
| 2008/0128005 | A1 | 6/2008 | Haeberle et al. |
| 2008/0160857 | A1 | 7/2008 | Chacko et al. |
| 2008/0236637 | A1 | 10/2008 | Pyo et al. |

FOREIGN PATENT DOCUMENTS

| | | | | |
|---|---|---|---|---|
| DE | 41 10 291 | | | 10/1992 |
| DE | 42 27 957 | | | 2/1994 |
| DE | 43 24 004 | | | 1/1995 |
| DE | 101 18 632 | | | 10/2002 |
| DE | 10 2005 061 805 | | | 6/2007 |
| DE | 10 2006 015 498 | | | 10/2007 |
| EP | 0 992 975 | | | 4/2000 |
| JP | 10-219869 | | * | 8/1998 |
| WO | WO 98/33170 | A1 | | 7/1998 |
| WO | WO 02/02302 | A2 | | 1/2002 |
| WO | WO 02/26100 | A2 | | 4/2002 |

* cited by examiner

DISHWASHER HAVING SOUND ATTENUATING STRUCTURES

BACKGROUND

The present invention relates to dishwashers and more particularly to structures and methods configured to attenuate sound generated from the dishwashers during use.

One issue of interest in the field of dishwashers is to reduce the externally perceptible noise generated by the dishwasher when the dishwasher is in use. Due to the number of mechanical devices cooperating to circulate the water to clean and rinse the dishware within the dishwasher, the sources and conduits of sound are numerous and determining ways to reduce the noise may be challenging.

BRIEF SUMMARY

One or more embodiments of a dishwasher are disclosed with an improved sound attenuating property. According to an embodiment, a dishwasher configured to clean dishware is provided. The dishwasher may include a tub configured to receive and hold the dishware and a first panel of an acoustic composite membrane. The acoustic composite membrane may include a layer of an acoustic tape comprising a plurality of first fibers extending in a first direction and of second fibers extending in a second direction and configured to redirect and convert at least a portion of a sound power level generated by the dishwasher into heat such that the sound power level perceivable outside the dishwasher is reduced. The first and second direction may be perpendicular such that the first and second fibers form a grid-like pattern. Alternatively, the acoustic tape may include a non-fibrous layer and a plurality of fibers mounted thereon.

The acoustic composite membrane may further include a first foam layer configured to absorb at least a portion of the sound power level and to reduce the speed of the sound power level prior to the sound power level reaching the acoustic tape. The acoustic composite membrane may also include a second foam layer and a vinyl layer between the first and second foam layers, the vinyl layer being configured to convert at least a portion of the sound power level into heat.

According to another embodiment, the dishwasher includes at least one mechanical device for operating the dishwasher and a base for supporting the tub and providing an enclosure for the at least one mechanical device. The base comprises a toe plate assembly that includes an inner support panel and an outer support panel. In this embodiment, the first panel of the acoustic composite membrane is adjacent an inner surface of the outer support panel. The dishwasher may further include a second panel of the acoustic composite membrane that is positioned adjacent an outer surface of the inner support panel.

In another embodiment, the dishwasher includes a door assembly configured to provide access to an interior of the tub. In this embodiment, the door assembly includes an inner wall, and an outer wall, and the first panel of the acoustic composite membrane is between the inner and outer walls.

In yet another embodiment, the dishwasher comprises a base for supporting the tub. The interface of the tub and the base defines a crevice between the tub and the base. In this embodiment, the first panel of the acoustic composite membrane extends along and over the crevice. The dishwasher may further include a layer of material configured to vibrate from the sound power level and positioned between the crevice and the first panel of the acoustic composite membrane.

Referring to yet another embodiment, the dishwasher may include a door assembly configured to provide access to an interior of the tub, a frame including a base configured to support the tub, and one or more framing elements extending from the base around the tub and proximate to the door assembly. In this embodiment, the first panel of the acoustic composite panel extends between the door assembly and a framing element along a first side of the tub and a second panel of the acoustic composite membrane extends between the door assembly and a framing element along a second side of the tub.

In other embodiments, instead of or in addition to the acoustic composite membrane described above, the dishwasher may include one or more other laminated structures including a layer of the acoustic tape. For example, the dishwasher may include a laminated structure positioned and configured to attenuate a sound power level generated by the dishwasher. The laminated structure including a layer of the acoustic tape and further include a first foam layer and second and third vinyl layers. The second vinyl layer may be between the first foam layer and the third vinyl layer. The laminated structure may be positioned within a cavity of the door assembly of the dishwasher.

In yet other embodiments, the dishwasher may include one or more panels of the acoustic composite membrane and other laminated structures positioned within the dishwasher according to any combination of the previous described embodiments or methods may be used to provide such a dishwasher.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
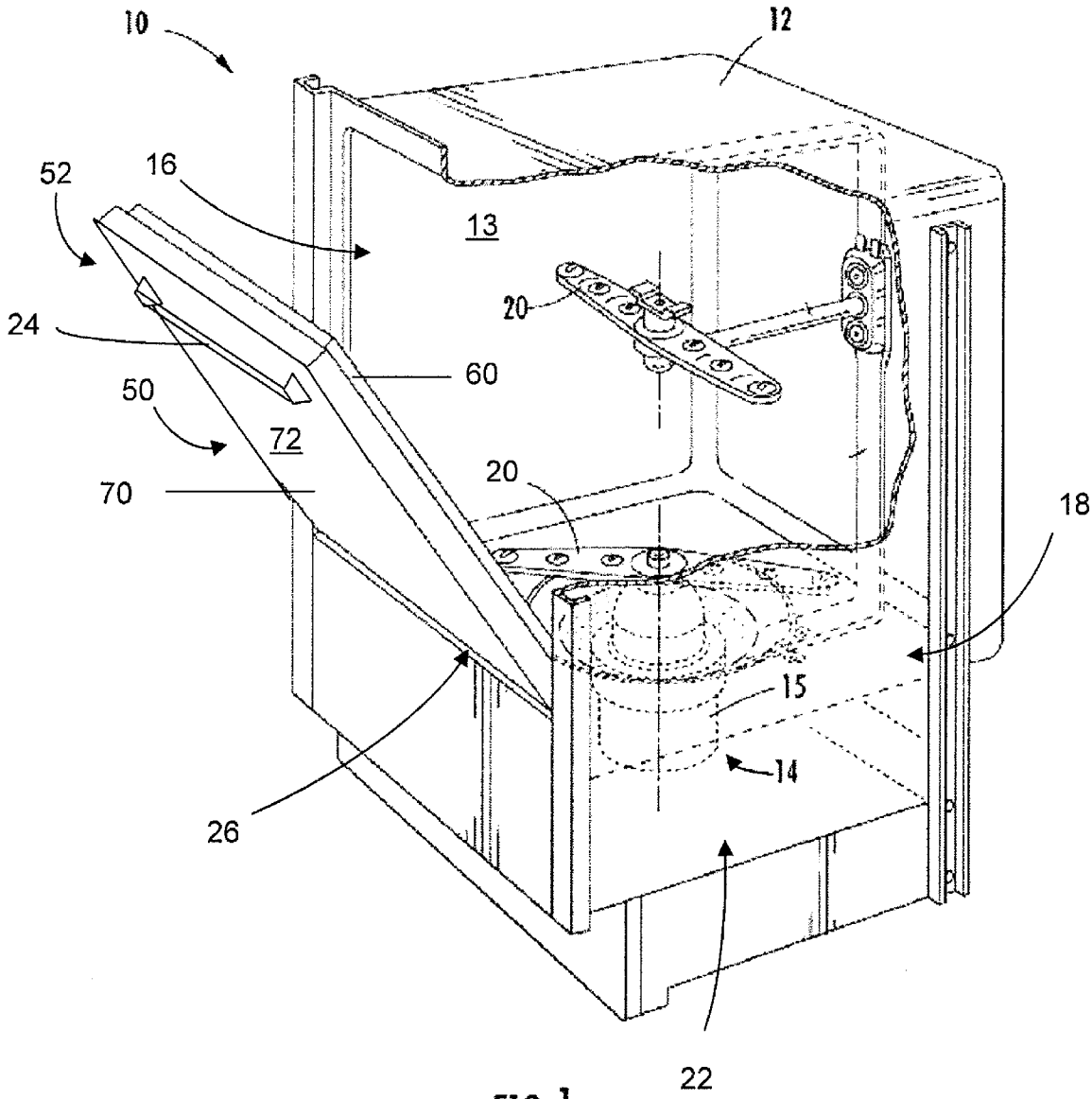
FIG. 1 is a perspective view of a dishwasher of a type suitable for use with various embodiments.

FIG. 1 illustrates an example of a dishwasher 10 that may benefit from various embodiments. The dishwasher 10 may include a tub 13 (partly broken away in FIG. 1 to show internal details) having a door assembly 50 and a plurality of walls 12 that together form an enclosure in which dishes, utensils, and other dishware may be placed for washing. The tub 13 may also define a forward access opening, generally designated as 16. As known in the art, the dishwasher 10 may also include slidable lower and upper racks (not shown) for holding the dishes, utensils, and other dishware to be washed. The tub 13 may define a sump, generally designated as 14, in which wash water or rinse water is collected, typically under the influence of gravity. The wash/rinse water may be pumped by a pump 15 out of the sump 14 to various spray arms 20 mounted in the interior of the tub 13 for spraying the wash/rinse water, under pressure, onto the dishes, utensils, and other dishware contained therein. The pump 15 and/or other mechanical devices (e.g., circulation pump, drain pump, water valve) that provide operational functions for the dishwasher may be housed, disposed, or otherwise positioned within a base 22 positioned beneath the tub 13, wherein the base 22 receives and supports a lower end 18 of the tub 13. In some instances, the base 22 may be a separate component with respect to the tub 13, such as, for example, a molded polymer component, while in other instances the base 22 may be integral with the tub 13 such that the side walls forming the tub 13 also at least partially form the base 22.

The door assembly 50 may be pivotably engaged with the tub 13 about the lower end 18 thereof so as to selectively permit access to the interior of the tub 13. That is, a lower edge 26 of the door assembly 50 may be pivotably engaged (e.g., hinged) with the lower end 18 of the tub 13 such that the door assembly 50 is pivotable about the lower edge 26 thereof to cover and seal the forward access opening 16 in a closed position when the dishwasher 10 is in operation, and to provide access to the interior of the tub 13 through the forward access opening 16 when the door assembly 50 is pivoted from the closed position to an opened position. In some instances, the door assembly 50 may comprise an inner wall 60 and an outer wall 70. The door assembly 50 may include a handle member 24 disposed on an outer surface 72 of the outer wall 70 to provide the user with a grasp portion.

Figure 2A:
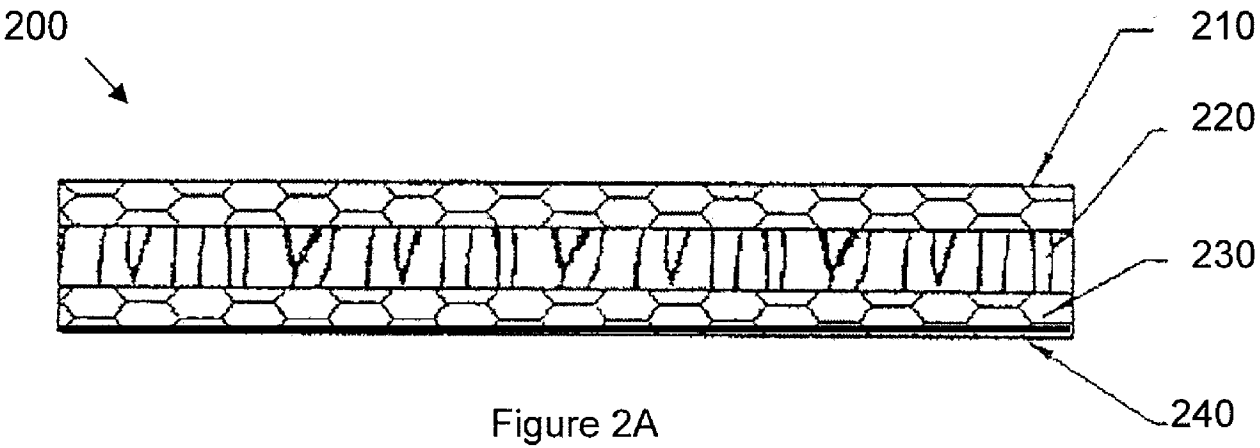
FIG. 2A is a cross-sectional view of an acoustic composite membrane consistent with various embodiments.
Figure 2B:
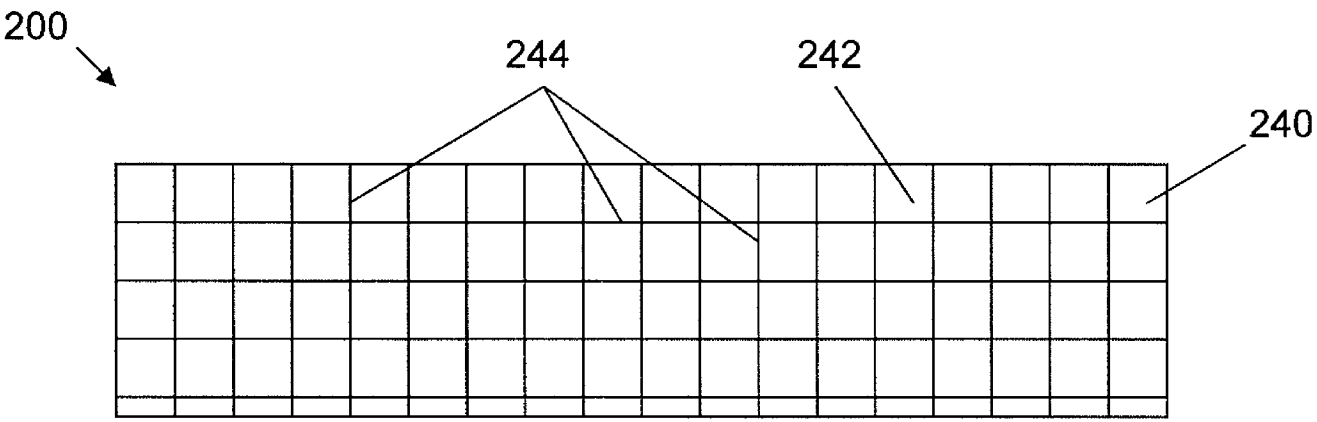
FIG. 2B is a bottom view of the acoustic composite membrane of FIG. 2A, wherein the acoustic tape layer is visible.

Embodiments are generally directed to the use of a composite acoustic membrane configured to manage sound and noise generated by the dishwasher. According to the embodiment illustrated in FIGS. 2A and 2B, the composite acoustic membrane 200 includes a first open cell foam layer 210, a mass loaded vinyl layer 220, a second open cell foam layer 230, and a layer of acoustic tape 240. The vinyl layer 220 is between the first and second foam layers 210 and 220. The acoustic tape 240 is adjacent one of the sides of a foam layer 230 opposite the vinyl layer 220. The acoustic tape 240 can be aluminum foil, metallized biaxially-oriented polyethylene terephthalate (boPET, also known by one of its trade names, MYLAR), or other foil material, with an adhesive backing. The adhesive backing may be used to adhere the acoustic tape 240 to one of the foam layers 230. As illustrated in FIG. 2B, the acoustic tape 240 further includes bi-directional polymer fibers 244 extending in a grid-like pattern (i.e., in a first direction and a second direction, wherein the first and second directions are generally perpendicular to each other) throughout or along a face of the foil material 242 or other non-fibrous layer. The composite acoustic membrane 200 according to the illustrated embodiment of FIGS. 2A and 2B is commercially available through a number of vendors including Cyber Bridge Marine Inc. of Henderson, Nev.

The thickness of any of the individual layers of the composite acoustic membrane may vary. For example, the thickness of the layers may be configured such that collectively the thickness of the layers provided an overall thickness of the acoustic composite membrane such that the acoustic composite membrane occupies a particular cavity or opening of the dishwasher. As another example, the relative thickness of the foam layers may vary depending on the application. In general, each of the foam layers absorbs and decelerates a portion of the sound transmitted through the layer regardless on the direction of the sound. The foam layer on either side of the vinyl layer absorbs and decelerates the sound before it reaches the vinyl layer regardless of the direction of the sound which increases the overall effectiveness of the composite acoustic membrane. In some applications, the sound coming from a particular side of the vinyl may be relatively minimal and in such case, the foam layer on that particular side may be relatively thinner than the other foam layer. It should be noted that, in some applications, it is believed that it is beneficial to manage not only the sound transmitted from inside the dishwasher to outside the dishwasher but also the sound transmitted from outside the dishwasher to the inside the dishwasher as well. Sound transmitted from outside the dishwasher to inside the dishwasher may eventually reflect back or otherwise contribute to the level of sound transmitted from the inside the dishwasher to the outside of the dishwasher.

A particular area of concern in a dishwasher in terms of noise is the toe plate. More specifically and as illustrated in FIG. 1, immediately below the door assembly 50 is a toe plate 52. Pumps 15, motors, and other mechanical devices of the dishwasher are often located behind the toe plate 52 (i.e., underneath the tub of the dishwasher). These mechanical devices contribute to the noise produced by the dishwasher 10 during use. However, conventional toe plates do not provide an effective barrier to the noise generated by these mechanical devices.

According to an embodiment, the dishwasher includes a toe plate assembly configured to reduce sound power emissions from the bottom-front area of the dishwasher. More specifically, according to the illustrated embodiment of FIGS. 3A-d, the toe plate assembly 300 includes an inner support panel 310 that is connected to or part of the frame of the dishwasher. The inner support panel 310 extends substantially across the width of the dishwasher below the door assembly 390. The inner support panel 310 may be made from various rigid materials such as a stainless steel or other metal. The inner support panel 310 may define an access opening and an access cover 320. The access cover 320 is attachable to the rest of the inner support panel, e.g., through a pair of fasteners 322. When attached, the access cover 320 is configured to cover the access opening such that the inner support panel 310 provides a completely enclosed front portion of a motor cavity 370 (i.e., an enclosed area of the dishwasher in which one or more mechanical devices, such as a motor, is housed). When unattached, the access opening provides at least partial access to the motor cavity 370 such as for installation operations.

The toe plate assembly 300 further includes a first panel 330 of the composite acoustic membrane. The first panel 330 is attached to the access cover 320, e.g., with the use of the pressure sensitive adhesive of the composite acoustic membrane. In general, the first panel 330 is shaped and sized to be approximately the same size or larger than the access opening and is attached to the access cover 320 such that when the access cover 320 is attached the first panel 330 is substantially centered on the access opening. Although, in the illustrated embodiment, the first panel 330 of the composite acoustic membrane does not cover the entire inner panel 310, it is positioned strategically in the center of the inner panel 310. The center of the inner panel 310 is the portion of the inner panel 310 further from any supporting elements and has the highest tendency to vibrate.

Figure 3A:
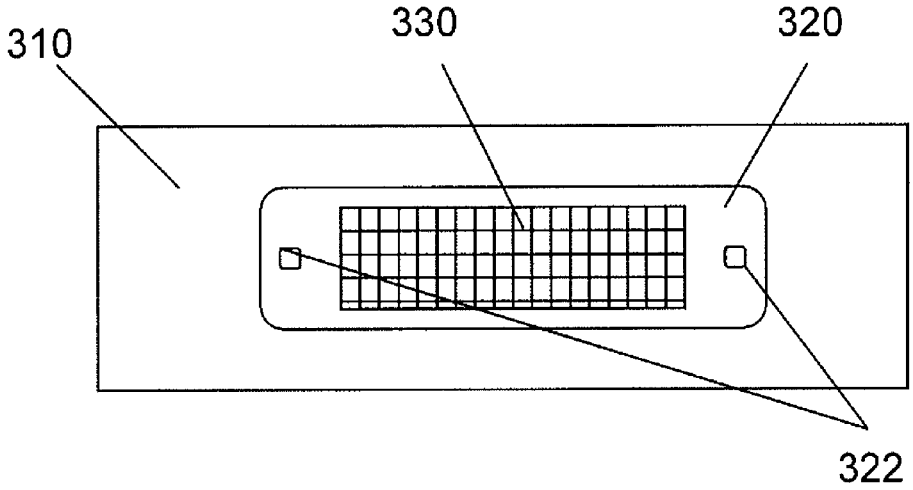
FIG. 3A is a front view of a first panel of a acoustic composite membrane and an inner support panel of a toe assembly according to an embodiment.
Figure 3B:
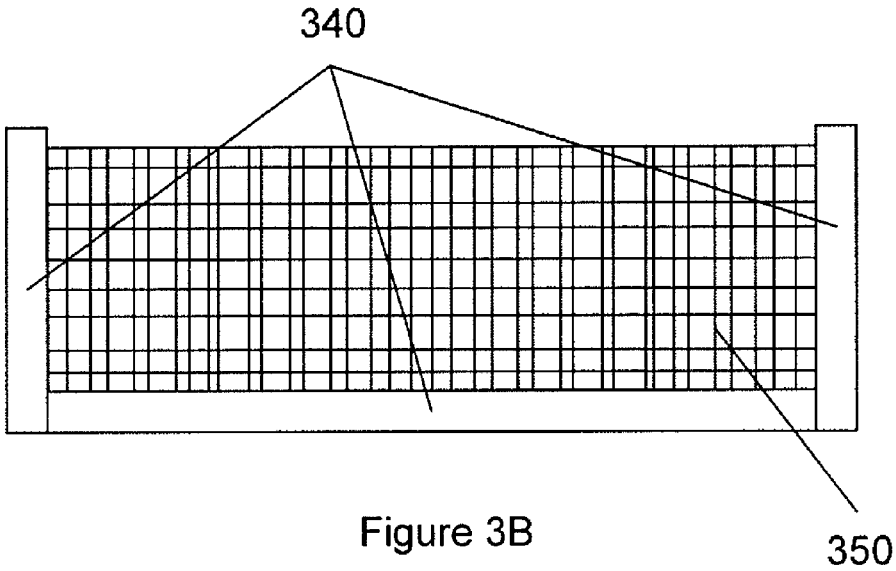
FIG. 3B is a front view of a second panel of the acoustic composite membrane of the toe assembly according to the embodiment of FIG. 3A.
Figure 3C:
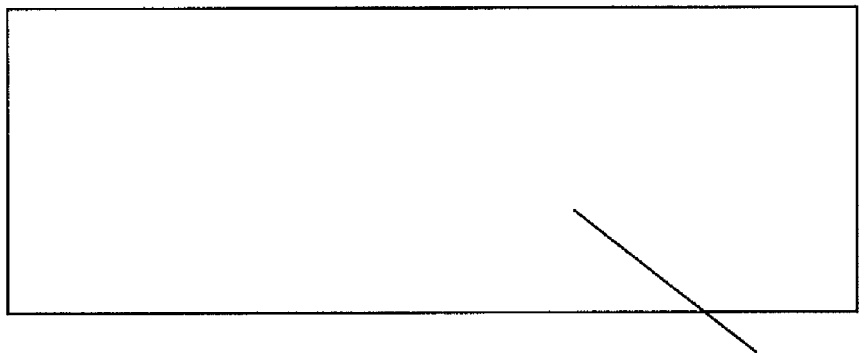
FIG. 3C is a front view of an outer support panel of the toe assembly according to the embodiment of FIG. 3A.
Figure 3D:
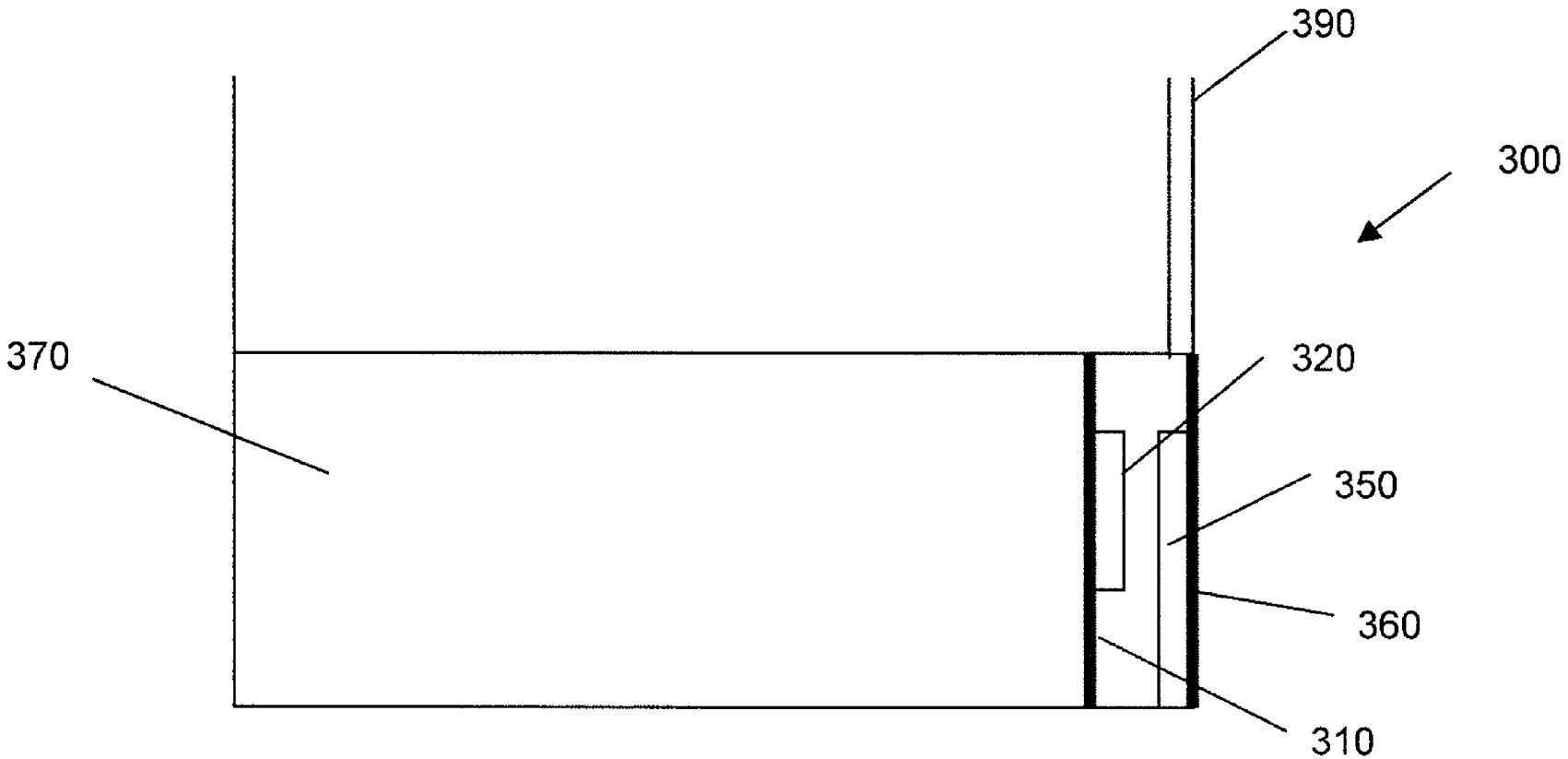
FIG. 3D is a cross-sectional view of the toe assembly of the embodiment of FIG. 3A.

The toe plate assembly 300 may include a second panel 350 of the composite acoustic membrane. The second panel 350 is positioned in front of (i.e., closer to the exterior of the dishwasher) the first panel of the composite acoustic membrane and the inner support panel. For example, as best shown in FIG. 3B, the dishwasher may include one or more support surfaces 340 extending in front of the inner support panel 310 and the second panel 350 of the composite acoustic membrane may be attached to these support surfaces 340 such that the second panel 350 of the composite acoustic membrane is secured and positioned in front of the first panel 330 of the composite acoustic membrane. The distance between the first and second panels 330 and 350 of the composite acoustic membrane may vary. For example, as illustrated in FIG. 3D, there may be a gap between the first and second panels 330 and 350. In other embodiments, there may not be any gap between the first and second panels of the composite acoustic membrane, i.e., the panels may be in contact with one another.

According to the illustrated embodiment of FIGS. 3A-3D, the toe plate assembly 300 further comprises an outer support panel 360. The outer support panel 360 is configured to extend in front of the second panel 350 of composite acoustic membrane and substantially across the width of the dishwasher below the door assembly. The outer support panel 360 may be made from various rigid materials such as a stainless steel or other metal. The outer support panel 360 may be attached to the dishwasher through various means, e.g., fasteners, hooks, latches, etc. When attached, the outer support panel 360 forms the outermost portion of the toe plate assembly 300. The second panel 350 of the composite acoustic membrane may be attached to the outer support panel 360, e.g., to an interior facing surface of the outer support panel.

Another embodiment is directed to the door assembly of the dishwasher which is another area of interest in terms of transmitting sound. As shown in FIG. 1, the door assembly 50 provides access to the tub 13 of the dishwasher where the dishware is loaded and washed. The water used to clean and rinse the dishware splashes against the door assembly 50 which transmits noise through the door assembly 50. Other sources of noise that may be transmitted through the door assembly 50 include the pumps 15 and fans in or proximate the tub 13 that operate during the clean and rinse cycles of the dishwasher 10 and vibrations created from the mechanical devices 15, 20 of the dishwasher 10 that transmit through the frame of the dishwasher 10 to the door assembly 50. Also, in some embodiments, the door assembly may house or contain one or more electronic components (not visible in FIG. 1) that may add to the noise being transmitted through the door assembly.

Figure 4:
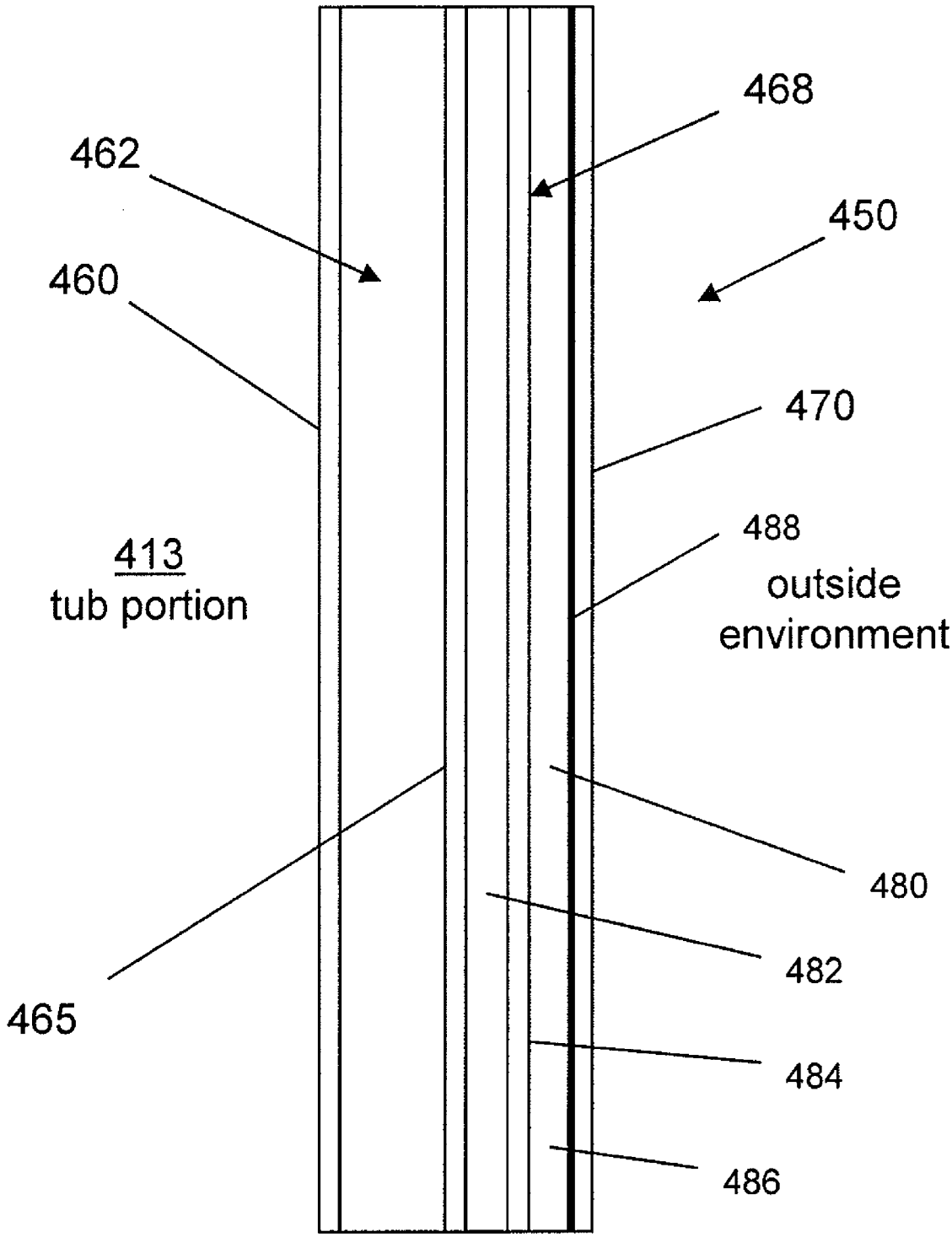
FIG. 4 is a cross-sectional view of a door assembly consistent with an embodiment.

As shown in FIG. 4, a door assembly 400 includes an inner wall 460 which is adjacent to the tub 413 of the dishwasher and an outer wall 470 which is adjacent to the outside environment of the dishwasher. According to the illustrated embodiment, the door assembly further includes an intermediate wall 465 extending between the inner and outer wall 460, 470. Each of the inner, intermediate, and outer walls 460, 465, 470 may be made from various rigid materials. The inner, intermediate, and outer walls 460, 465, 470 are spaced from each other defining a first cavity 462 between the inner and intermediate walls 460, 465 and a second cavity 468 between the intermediate and outer walls 465, 470. Although not illustrated, the door assembly 500 may include one or more components such as a detergent dispenser, a drying system (e.g., a drying duct), and a user input panel. These components may be supported within the first and second cavities 462, 468.

The door assembly may include a panel 480 of the acoustic composite membrane positioned within one of the cavities 462, 468. For a more specific example and according to the illustrated embodiment of FIG. 4, the panel 480 may be positioned within the second cavity 468 such that the panel of the acoustic composite membrane extends from the intermediate wall 465 to the outer wall 470. The panel 480 may be shaped and sized that the acoustic composite membrane substantially occupies the entire cavity 468. In embodiments in which the second cavity contains additional components such as a drying system or a dispenser, the acoustic composite membrane could be configured to define openings or shapes such that the acoustic composite membrane extends at least partially around such components or otherwise provides space for the components.

According to the illustrated embodiment of FIG. 4, the acoustic composite membrane includes a first layer 482 of an open cell foam material configured to act as an incident absorber inbound/outbound geometry capturing a portion of the sound power generated from inside the dishwasher, such as water splashing against the door assembly. The second layer 484 of the acoustic composite membrane is a loaded vinyl material configured to act as a sound power-thermal converter. More specifically, the sound power that reaches the loaded vinyl material causes the loaded vinyl material to vibrate and, thus, convert at least a portion of the sound power into heat. The third layer 486 of the acoustic composite membrane is similar to the first layer 482 in that it is of an open cell foam material configured to act as an incident absorber inbound/outbound geometry capturing a portion of the sound power that is transmitted through the first and second layers 482, 484 or through the outer wall 470 of the door assembly.

The sound power not absorbed or converted into heat by the first, second, and third layers 482, 484, 486 may be transmitted onto the fibers of the acoustic tape layer. In particular, the panel 480 of the acoustic composite membrane includes a fourth layer 488 and the fourth layer may be a layer of the acoustic tape as described above, including the bi-directional polymer fibers. In general, the acoustic tape may be configured to provide protection and structural stability to the rest of the composite acoustic membrane. However, it is believed that the bi-directional polymer fibers may be positioned and configured to provide an additional benefit. For example, the bi-directional polymer fibers redirect a portion of the sound power level along the fibers, i.e., in four directions (up, down, left, right), where it is converted or transformed into heat. Moreover, the acoustic tape includes a reflective foil material which also reflects or refracts a portion of the sound power level. Individually and collectively, the fibers and the foil material further reduce the sound power level that transmits through the door assembly which may be perceivable to consumers The panel 480 of the acoustic composite membrane may have a first orientation within the door assembly. For example, according to the illustrated embodiment, the acoustic tape layer 488 may be adjacent the outer panel 470 such that the acoustic tape is considered to be facing the outside environment of the dishwasher. As another example (not illustrated), in a second orientation, the acoustic tape layer is adjacent the intermediate panel such that the acoustic tape is considered to be facing the tub. In both the first and second orientation, the panel of the composite acoustic membrane may include an adhesive, such as a pressure-sensitive adhesive, for adhering the first layer to either the outer panel or the intermediate panel.

The door assembly 450 may include an additional panel of the acoustic composite membrane that is positioned within the first cavity. In other embodiments, the door assembly may include a panel of expanded polystyrene or Styrofoam® positioned within the first cavity to further help to insulate the door assembly or to provide additional support or stiffening of the door assembly.

Figure 5:
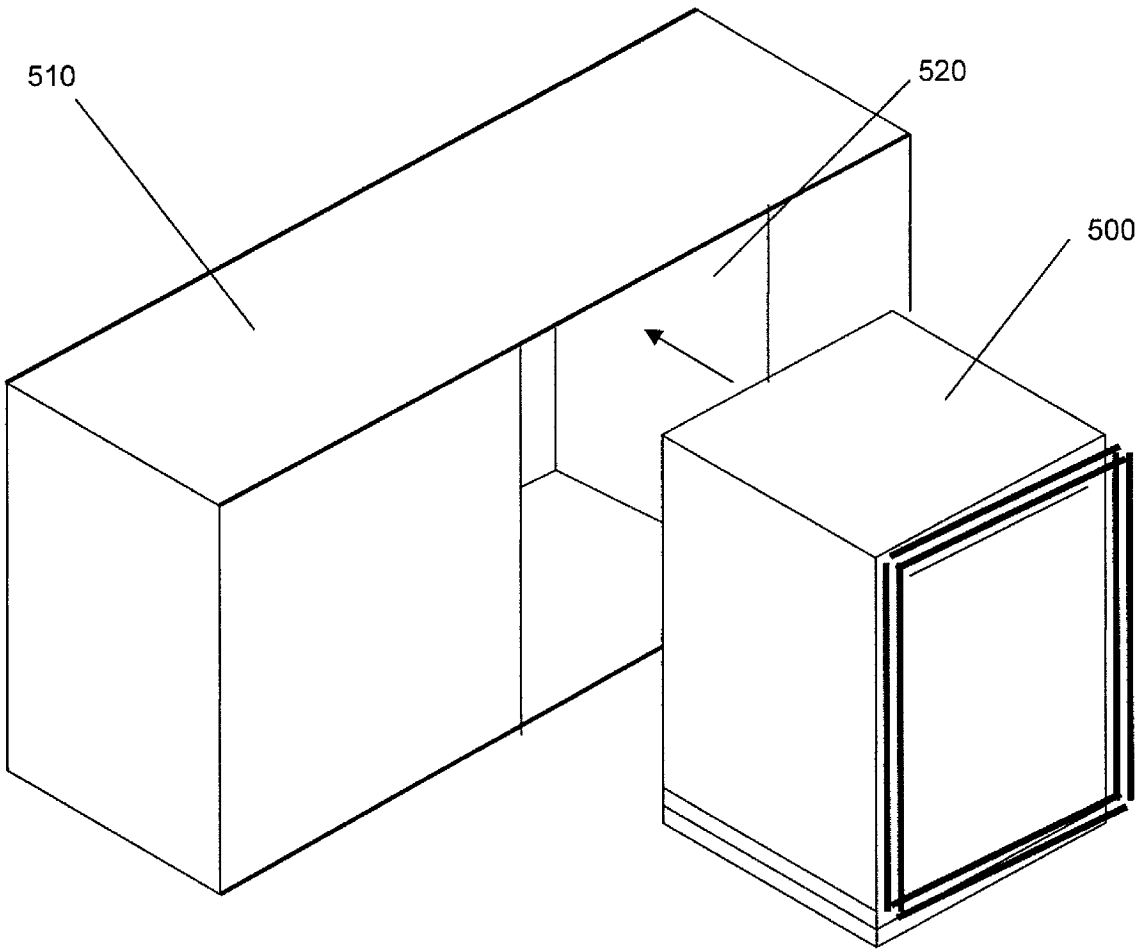
FIG. 5 is a perspective view of a dishwasher and a cabinet suitable for use with various embodiments.
Figure 6A:
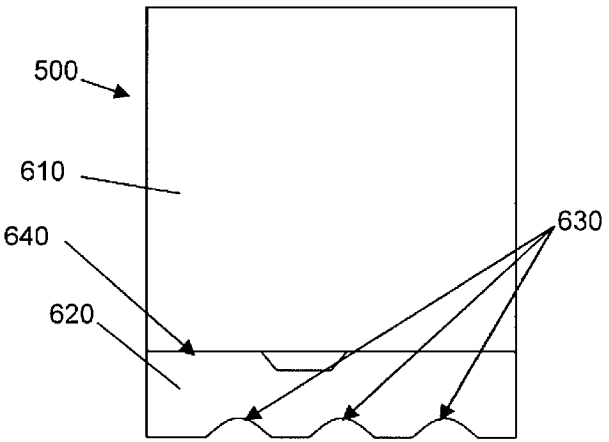
FIG. 6A is a rear view of the dishwasher of FIG. 5.
Figure 6B:
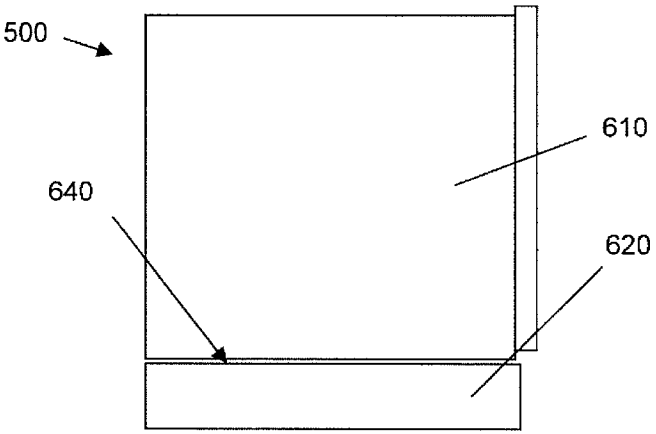
FIG. 6B is a side view of the dishwasher of FIG. 5.

As illustrated in FIG. 5, a dishwasher 500 may be configured to be contained within a cavity 510 of a cabinet 520. Within the cavity 510, the dishwasher 500 may be connected to an electrical source, a hot water source, and a drainage hose. More specifically and referring to FIGS. 6A-*b*, the dishwasher 500 may include a tub 610 and a base 620. The base 620 supports the tub 610 and may enclose one or more fans, pumps, valves, motors, and/or other mechanical devices of the dishwasher. The base 620 may also include casters and adjustable legs for helping to move the dishwasher and to level the dishwasher relative to the floor or cavity. The toe plate assembly discussed above may at least partially or completely form the front portion of the base 620. As shown in FIG. 6A, the base 620 may form one or more openings 630. These openings 630 may be configured to receiving an electrical cable, a drain hose, or a hot water hose such that the cables and hoses have access to any valves and outlets enclosed within the base.

In general, the base 620 includes four panels configured to engage the perimeter of the lower end of the tub 610. The interface of the tub 610 and the base 620 define an aperture or crevice 640 extending along the perimeter of the lower end of the tub 610. The aperture 640 may be a conduit of sound generated from several sources including any fans, pumps, valves, and motors enclosed in the base 620. Moreover, the crevice 640 may also be a conduit of sound generated from the hoses extending in and out of the dishwasher, including transmitting sound back toward the dishwasher.

Figure 7A:
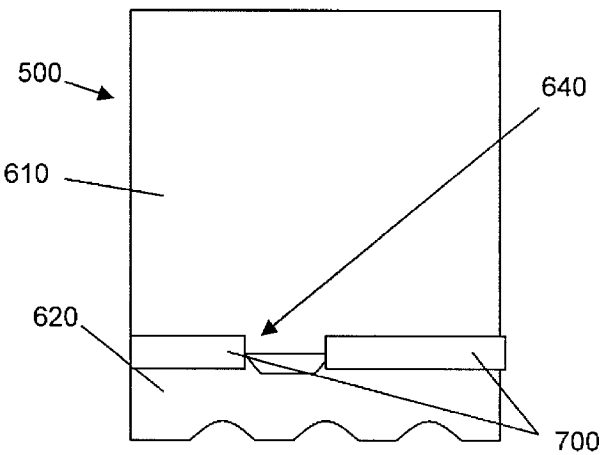
FIG. 7A is a rear view of the dishwasher of FIG. 5 with the installation of a foil layer 700 consistent with an embodiment.
Figure 7B:
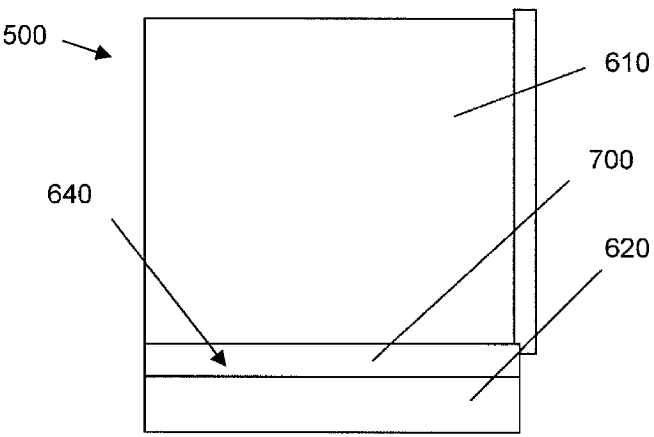
FIG. 7B is a side view of the dishwasher of FIG. 5 with the installation of a foil layer 700 consistent with an embodiment.
Figure 8B:
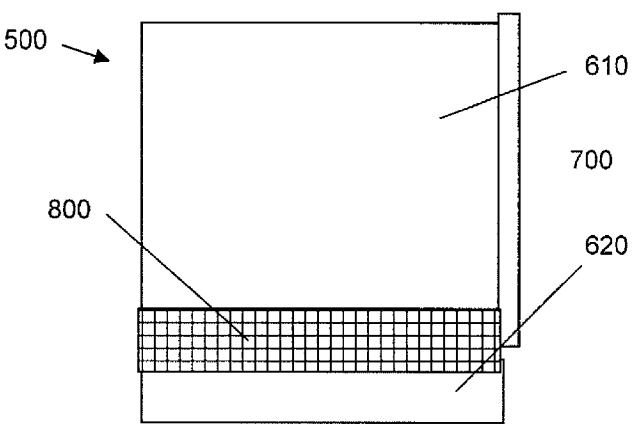
FIG. 8B is a side view of the dishwasher of FIG. 5 with the installation of an acoustic composite membrane 800 consistent with an embodiment.
Figure 8A:
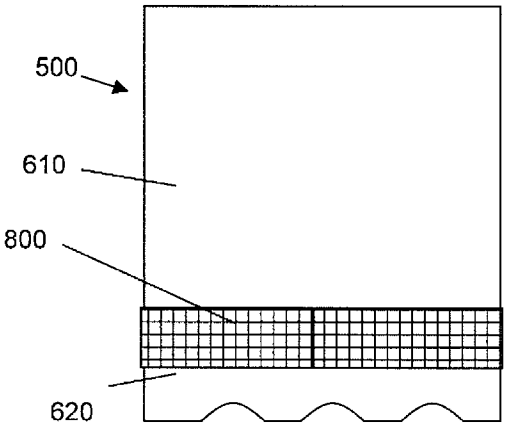
FIG. 8A is a rear view of the dishwasher of FIG. 5 with the installation of an acoustic composite membrane 800 consistent with an embodiment.

A further embodiment is directed to reducing the sound transmission through the aperture 640. Referring to FIGS. 7A and 7B, the embodiment may include a first foil layer 700, e.g., a foil tape with an adhesive backing, that is applied substantially over the aperture 640 including substantially around the perimeter of the lower end of the tub 610. Now referring to FIGS. 8A and 8B, the embodiment may further include an acoustic composite membrane 800 applied over the first foil layer 700 (not visible in FIGS. 8A and 8B). According to the illustrated embodiment, the acoustic composite membrane 800 includes a first foam layer, a mass loaded vinyl layer, a second foam layer, and a layer of acoustic tape. The acoustic composite membrane 800 may further include an adhesive coating, e.g., a pressure-sensitive adhesive, for adhering the acoustic composite membrane 800 to the first foil layer 700, the tub 610, or the base 620.

It is believed that the vinyl layer of the acoustic composite membrane is effective at absorbing sound at a low frequency (30-300 kHz) and each foam layer is effective at absorbing sound at a medium frequency (300-3000 kHz). It is also believed that the excess at a high frequency (3-30 MHz) is transformed into heat which dissipates in two directions along the fibers of the acoustic tape and excess noise is attenuated at the intersections of the fibers (which function as acoustic nodes).

Figure 9B:
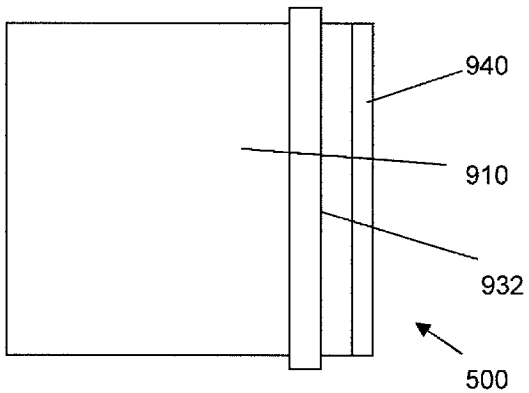
FIG. 9B is a top view of the dishwasher of FIG. 9A.
Figure 9A:
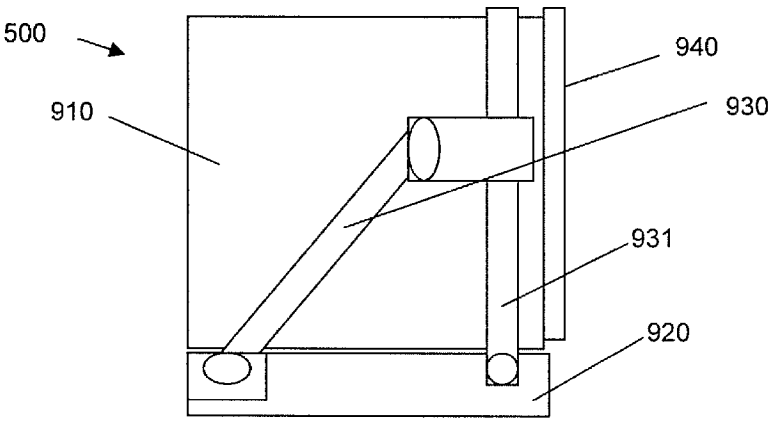
FIG. 9A is a left side view of the dishwasher of FIG. 5 with frame support members suitable with various embodiments.
Figure 9C:
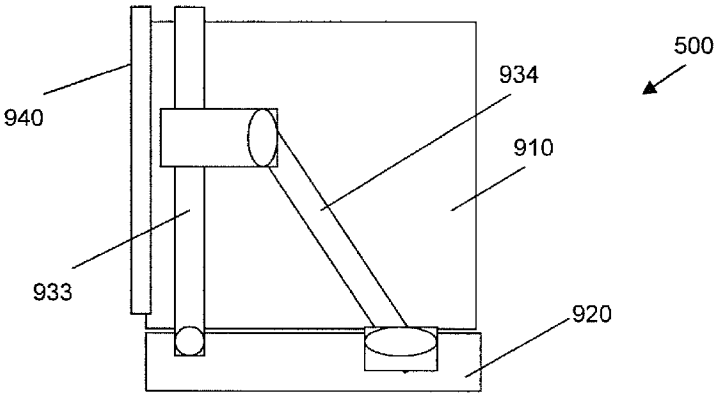
FIG. 9C is a right side view of the dishwasher of FIG. 9A.

As illustrated in FIGS. 9A and 9B, the base 920 may be part of a frame assembly of the dishwasher 500. For example, the frame assembly may include the base 920 and one or two frame elements 930, 931, 932, 933, 934 configured to support the tub 910. Each frame element 930, 931, 932, 933, 934 may comprise a rigid, e.g., stainless steel, material. In general, the frame elements 930, 931, 932, 933, 934 are configured to support the tub 910 on the base 920 such that the tub 910 is less likely to move relative to the base 920. As illustrated, the frame assembly may include one or more frame elements 931, 932, 933 that extend from one side of the base around the tub to the other side of the base. These frame elements 931, 932, 933 (referred to herein as the front frame elements) are proximate the door assembly 940 and are configured to secure the tub 910 to the base while the door assembly 940 is opened and closed.

Figure 10B:
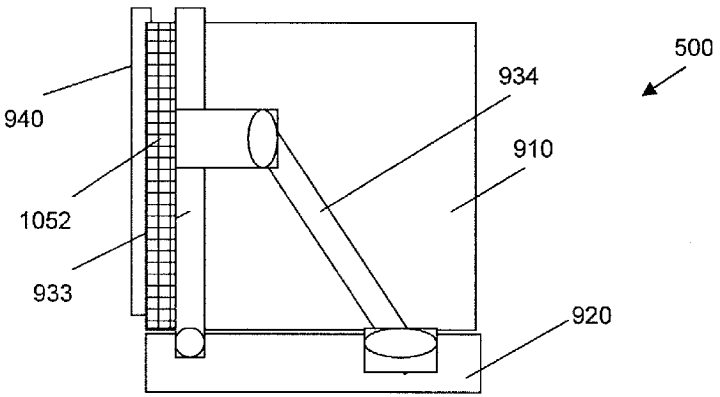
FIG. 10B is a right side view of the dishwasher of FIG. 9A with the installation of an acoustic composite membrane consistent with an embodiment
Figure 10A:
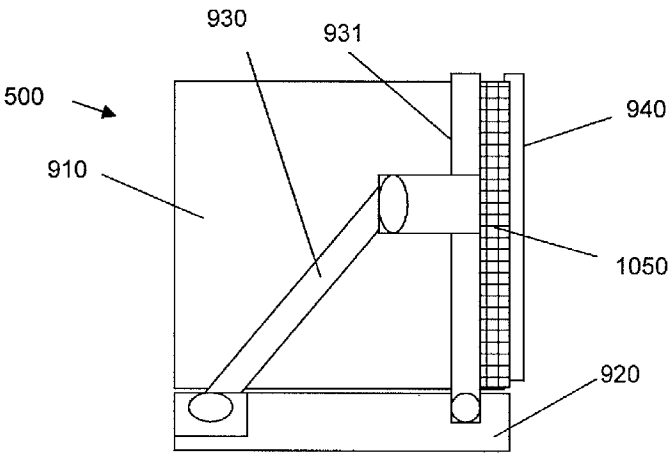
FIG. 10A is a left side view of the dishwasher of FIG. 9A with the installation of an acoustic composite membrane consistent with an embodiment.

According to the embodiment illustrated in FIGS. 10A and 10B, a panel of an acoustic composite membrane 1050, 1052 are applied substantially between the side front frame elements 931, 933 and the door assembly 940. The positioning of the panels between the front frame elements and the door assembly helps to reduce the externally perceptible noise generated by the dishwasher during use.

Figure 11B:
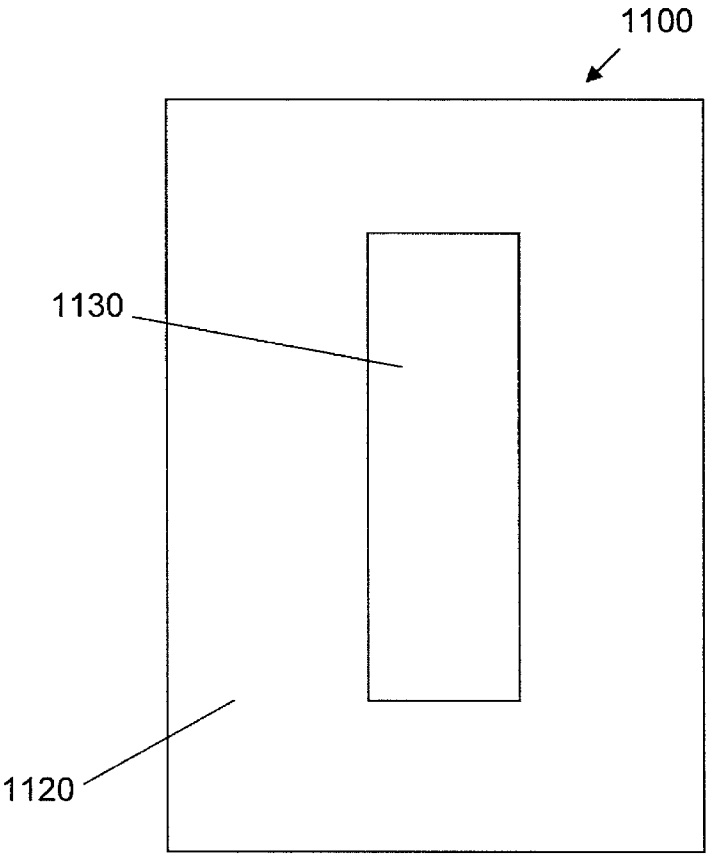
FIG. 11B is a rear cross-sectional view of the door assembly of FIG. 11A.
Figure 11A:
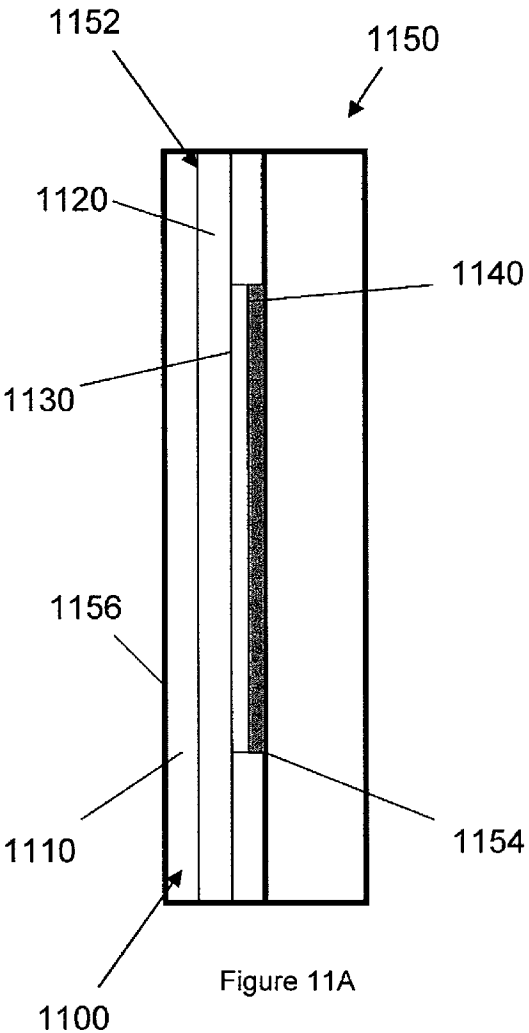
FIG. 11A is a side cross-sectional view of a door assembly consistent with an embodiment.

FIGS. 11A and 11B illustrate yet another embodiment, according to this embodiment another laminated structure is provided referred to herein as an acoustic attenuation composite 1100. In general, the acoustic attenuation composite 1100 is configured to attenuate sound generated from the dishwasher during use. As a more specific example and as illustrated, the acoustic attenuation composite may be positioned within a cavity 1152 of the door assembly 1150 such as between an intermediate panel 1154 and an outer panel 1156 of the door assembly. In such a position, the acoustic attenuation composite 1100 is configured to convert a portion of the sound or, more specifically, the sound power level ("SPL") transmitted through the door assembly 1150 into heat such that the noise perceivable outside the dishwasher is lowered.

According to the illustrated embodiment, the acoustic attenuation composite 1100 is a laminated structure that includes a first layer 1110, a second layer 1120, and a third layer 1130. The first layer 1110 may be a polystyrene foam or Styrofoam® panel that is shaped and sized to substantially cover an inner surface of the outer panel 1156 of the door assembly. The first layer 1110 may be directly behind and adjacent to the outer panel 1156. The second layer 1120 may be a mass-loaded vinyl layer that is shaped and sized substantially the same as the first layer 1100 and is directly behind and adjacent the first layer 1110. The third layer 1130 may be another mass-loaded vinyl layer. However, according to the illustrated embodiment, unlike the second layer 1120, the third layer 1130 is smaller such that the third layer 1130 covers only a central portion of the first and second layers 1110, 1120. The third layer 1130 may be positioned to be centered on the second layer 1120 and between the second layer 1120 and the intermediate panel 1154 of the door assembly.

Collectively, the first, second, and third layers 1110, 1120, 1130 may extend completely from the intermediate panel 1154 to the outer panel 1156 of the door assembly. The layers 1110, 1120, 1130 may be held in place by an interference fit between the layers 1110, 1120, 1130 and the panels 1154, 1156. In other embodiments, a pressure sensitive adhesive may be added to the second and third layers to help hold the layers together. The use of the pressure sensitive adhesive may also ease the manufacturing and assembling of the door assembly having the acoustic attenuation composite 1100.

The acoustic attenuation composite 1110 may also include a layer of the acoustic tape 1140 described above. For example and as illustrated, the acoustic tape 1140 may be applied to the top of the third layer 1140, i.e., between the third layer 1130 and the intermediate panel 1140.

In operation, as the SPL from the dishwasher vibrates, the intermediate panel 1140 of the door assembly creates structural noise that may be absorbed by the third layer. Excess noise may then be transmitted to the second layer 1120, where more of the structural noise may be absorbed and converted into heat. Excess structural noise may then vibrate the outer panel 1156 of the door assembly and exit as the residual noise out to the environment. It is believed that any residual noise will have a controlled high/low sine wave amplitude that may be more acceptable to customers. It is also believed that the fibers of the acoustic tape help to redirect and defuse a portion of the SPL.

The above embodiments describe positioning one or more panels of an acoustic composite membrane or other laminated structures configured to attenuate sound throughout the dishwasher. It is understood that one or more of the embodiments above may be combined to provide a dishwasher having the panels of the acoustic composite membrane in one or more of the following locations: (1) in front of an inner panel of a toe kick assembly; (2) behind an outer panel of the toe kick assembly; (3) within a cavity of the door assembly; (4) along an aperture defined between the tub and the base; and (5) between the front frame elements and the door assembly. The positioning and use of the panels of an acoustic composite membrane reduces the externally perceptible noise generated by the dishwasher during use including sound generated from the water splashing against the inner walls of the dishwasher and structure borne noise emitted by the drain motor, drain valve, recirculation motor, hydraulic hoses, water supply hose, and fans.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher configured to clean dishware comprising:

a tub configured to receive and hold the dishware; and a first panel of an acoustic composite membrane including a layer of an acoustic tape, the acoustic tape comprising a plurality of first fibers extending in a first direction and a plurality of second fibers extending in a second direction, the acoustic tape being positioned and configured to convert at least a portion of a sound power level generated by the dishwasher into heat such that the sound power level outside the dishwasher is reduced, wherein the first and second directions perpendicular to each other forming a grid-like pattern, wherein the acoustic composite membrane further includes a first foam layer configured to absorb at least a portion of the sound power level and to reduce the speed of the sound power level prior to the sound power level reaching the acoustic tape, and wherein the acoustic composite membrane further includes a second foam layer and a vinyl layer between the first and second foam layers, the vinyl layer being configured to convert at least a portion of the sound power level into heat.

2. The dishwasher according to claim 1 further comprising at least one mechanical device for operating the dishwasher, a base for supporting the tub and providing an enclosure for the at least one mechanical device, the base comprising a toe plate assembly including an inner support panel and an outer support panel, the first panel of the acoustic composite membrane being adjacent an inner surface of the outer support panel, and a second panel of the acoustic composite membrane adjacent an outer surface of the inner support panel.

3. The dishwasher according to claim 1 further comprising a door assembly configured to provide access to an interior of the tub, the door assembly including an inner wall and an outer wall, and wherein the first panel of the acoustic composite membrane is between the inner and outer walls.

4. The dishwasher according to claim 1 further comprising a base for supporting the tub, the tub and base defining a crevice between the tub and the base, wherein the first panel of the acoustic composite membrane extends along and over the crevice.

5. The dishwasher according to claim 4 further comprising a layer of material configured to vibrate from the sound power level, the layer of material being positioned between the crevice and the first panel of the acoustic composite membrane.

6. The dishwasher according to claim 1 further comprising a door assembly configured to provide access to an interior of the tub, a frame including a base configured to support the tub and one or more framing elements extending from the base around the tub and proximate to the door assembly, and wherein the first panel of the acoustic composite panel extends between the door assembly and a framing element along a first side of the tub and a second panel of the acoustic composite membrane extends between the door assembly and a framing elements along a second side of the tub.

7. The dishwasher according to claim 1 further comprising a door assembly configured to provide access to the tub, at least one mechanical device for operating the dishwasher, a frame including one or more framing elements and a base for supporting the tub, the base being configured to provide an enclosure for the at least one mechanical device and including a toe plate assembly, the toe plate assembly comprising an inner support panel and an outer support panel, the first panel of the acoustic composite membrane being adjacent an inner surface of the outer support panel, a second panel of the acoustic composite membrane adjacent an outer surface of the inner support panel, and a third panel of the acoustic composite membrane between an inner wall and an outer wall of the door assembly.

8. The dishwasher according to claim 7 further comprising a fourth panel of the acoustic composite membrane extending along and over a crevice between the tub and the base, a layer of material configured to vibrate from the sound power level and the layer of material being positioned between the crevice and the fourth panel of the acoustic composite membrane, a fifth panel of the acoustic composite membrane extending between the door assembly and a framing element along a first side of the tub, and a sixth panel of the acoustic composite panel extending between the door assembly and a framing element along a second side of the tub.

9. A dishwasher configured to clean dishware comprising:

a tub configured to receive and hold the dishware; and a laminated structure positioned and configured to attenuate a sound power level generated by the dishwasher, the laminated structure including a layer of an acoustic tape, the acoustic tape comprising a non-fibrous layer and a plurality of fibers mounted thereon, and wherein the plurality of fibers is configured to convert at least a portion of a sound power level generated by the dishwasher into heat such that the sound power level outside the dishwasher is reduced, wherein the laminated structure further includes first and second foam layers configured to absorb at least a portion of the sound power level and to reduce the speed of the sound power level prior to the sound power level reaching the acoustic tape and a vinyl layer between the first and second foam layers, the vinyl layer being configured to convert at least a portion of the sound power level into heat.

10. The dishwasher according to claim 9, wherein the laminated structure is positioned within a cavity of a door assembly of the dishwasher.

11. The dishwasher according to claim 10, wherein the laminated structure further includes a first foam layer and second and third vinyl layers and, wherein the second vinyl layer is between the first foam layer and the third vinyl layer.

12. The dishwasher according to claim 11, wherein the first foam layer is a polystyrene foam.

13. A method of attenuating sound generated from a dishwasher, the method comprising:

providing a dishwasher, including a tub configured to receive and hold dishware, a door assembly configured to provide access to an interior of the tub, a frame including a base configured to support the tub and one or more framing elements extending from the base around the tub;

placing an acoustic composite membrane in a position external to the tub, the acoustic composite membrane configured to convert at least a portion of the sound generated by the dishwasher into heat, the acoustic composite membrane comprising a layer of an acoustic tape, the acoustic tape including a plurality of first fibers extending in a first direction and a plurality of second fibers extending in a second direction, wherein the acoustic composite membrane further comprises a first foam layer configured to absorb at least a portion of the sound and to reduce the speed of the sound prior to the sound reaching the acoustic tape, and wherein the acoustic composite membrane further comprises a second foam layer and a vinyl layer between the first and second foam layers, the vinyl layer being configured to convert at least a portion of the sound power level into heat.

14. The method of claim 13, wherein the dishwasher further comprises a toe plate assembly including an inner support panel and an outer support panel, and the acoustic composite membrane is located between the inner and outer support panels.

15. The method of claim 13, wherein the door assembly further comprises an inner wall and an outer wall, and wherein the acoustic composite membrane is located between the inner and outer walls.

16. The method of claim 13, wherein the tub and base define a crevice between the tub and the base, and wherein the acoustic composite membrane extends along and over the crevice.

17. The method of claim 16 further comprising a layer of material configured to vibrate from the sound, the layer of material being positioned between the crevice and the first panel of the acoustic composite membrane.

* * * * *